US008395073B2

(12) United States Patent
Okawa

(10) Patent No.: US 8,395,073 B2
(45) Date of Patent: Mar. 12, 2013

(54) CONTINUOUS ROLLING METHOD AND CONTINUOUS ROLLING APPARATUS

(75) Inventor: Susumu Okawa, Kanagawa (JP)

(73) Assignee: JP Steel Plantech Co. (JP)

( * ) Notice: Subject to any disclaimer, the term of this patent is extended or adjusted under 35 U.S.C. 154(b) by 248 days.

(21) Appl. No.: 11/449,267

(22) Filed: Jun. 8, 2006

(65) Prior Publication Data

US 2006/0278615 A1 Dec. 14, 2006

(30) Foreign Application Priority Data

Jun. 9, 2005 (JP) ..... 2005-169115

(51) Int. Cl.
*B23K 9/00* (2006.01)

(52) U.S. Cl. ..... 219/97; 219/100

(58) Field of Classification Search ..... 219/97, 219/100, 121.44; 228/167, 168, 169
See application file for complete search history.

(56) References Cited

U.S. PATENT DOCUMENTS

| | | | | |
|---|---|---|---|---|
| 4,217,478 | A * | 8/1980 | Kuchuk-Yatsenko et al. | 219/97 |
| 5,767,475 | A * | 6/1998 | Takashima | 219/117.1 |
| 6,058,605 | A * | 5/2000 | Binder et al. | 29/897.2 |
| 6,429,398 | B1 * | 8/2002 | Legoupil et al. | 219/97 |
| 6,787,731 | B1 * | 9/2004 | Prioretti et al. | 219/121.44 |

FOREIGN PATENT DOCUMENTS

| | | | |
|---|---|---|---|
| EP | 0 761 328 | A | 3/1997 |
| EP | 0 925 875 | A | 6/1999 |
| EP | 1 057 563 | A | 6/2000 |
| EP | 1057563 | A1 | 6/2000 |
| EP | 1 147 845 | A | 10/2001 |
| JP | 52-43754 | | 4/1977 |
| JP | 56158237 | A * | 12/1981 |
| JP | 9-66301 | | 3/1997 |
| JP | 09066302 | A * | 3/1997 |
| JP | 11019776 | A * | 1/1999 |
| JP | 11-104844 | A * | 4/1999 |
| JP | 11104844 | A * | 4/1999 |
| JP | 2003-126973 | A * | 5/2003 |
| JP | 2003126973 | A * | 5/2003 |
| KR | 2002009131 | A * | 2/2002 |

OTHER PUBLICATIONS

Machine translation of Japan Patent No. 11-104,844, Feb. 2010.*

* cited by examiner

*Primary Examiner* — Henry Yuen
*Assistant Examiner* — Ayub Maye
(74) *Attorney, Agent, or Firm* — DLA Piper LLP (US)

(57) ABSTRACT

The continuous rolling method and the continuous rolling apparatus provide good product quality and product yield by successively joining pluralities of traveling hot steel pieces by flash welding, and by rolling thus prepared endless steel piece, thus preventing generation of flaws in the rolling step, thereby manufacture steel rods, wires, and the like by the continuous rolling technology. The method has: a heating step for heating billet to a specified temperature; a flash welding step for joining the trailing end of preceding billet with the leading end of succeeding billet while they are traveling using flash welding; a deburring step for removing burrs from the welded part; a trimming step for trimming corners of cross section of the deburred welded part; and a rolling step for rolling the joined billets.

6 Claims, 11 Drawing Sheets

PRIOR ART

PRIOR ART

PRIOR ART

PRIOR ART

CONTINUOUS ROLLING METHOD AND CONTINUOUS ROLLING APPARATUS

TECHNICAL FIELD

This disclosure relates to a continuous rolling method for efficiently manufacturing steel rod, wire, and the like by successively joining traveling high temperature steel pieces by flash welding (also called flash-butt welding), and then by rolling thus formed endless steel piece, and to a continuous rolling apparatus therefor.

BACKGROUND

Conventional rolling lines of steel rods, wires, and the like manufacture the products by rolling steel pieces such as blooms and billets one by one. In recent years, however, there has been proposed a technology of preventing the reduction of product yield resulting from cutting to remove the crops of leading and trailing ends of steel pieces and improving productivity by eliminating idle time between steel pieces. According to that technology, pluralities of steel pieces delivered from a heating furnace or directly fed from a continuous casting machine are welded with each other while traveling by a traveling flash welding machine at an upstream side of the rolling mill train or in the rolling mill train to form an endless steel piece. Thus formed endless steel piece is continuously rolled as disclosed in Japanese Patent Publication Nos. 52-43754 and 9-66301.

During the operation of the above technology, the welded parts of steel pieces which were joined together by flash welding form welding burrs. Since the welding burrs are relatively large, they generate flaws in the succeeding rolling step to decrease the product yield, and they may cause a break or the like in the rolling step. Consequently, those welding burrs have to be removed before rolling after the welding.

There is a known deburring machine to remove welding burrs from flash welded parts, which is a deburring machine built in a traveling flash welding machine. FIG. 12 shows a continuous rolling apparatus provided with that type of deburring machine, and FIG. 13 shows a perspective view of a core part of that deburring machine.

In FIG. 12, the rolling line has a heating furnace 10, a traveling flash welding machine 20, and a rolling mill 60, in sequential order. The traveling flash welding machine 20 has a deburring machine 30. As illustrated in FIG. 13, the deburring machine 30 is equipped with a vertical deburring cutter 31 in a downward-opening angular U-shape, a hydraulic cylinder 32 to drive the vertical deburring cutter 31 in the vertical directions, a horizontal deburring cutter 33 in a side-opening angular U-shape, and a hydraulic cylinder 34 to drive the horizontal deburring cutter 33 in the horizontal directions. The reference numbers 21*a* and 22*b* in FIG. 13 signify welding clamps to conduct flash welding while clamping to upset a preceding billet 1*a* and a succeeding billet 1*b*, respectively.

In such a structured rolling line, the leading end of the succeeding billet 1*b* delivered from the heating furnace 10 and the trailing end of the preceding billet 1*a* are welded together by the traveling flash welding machine 20, and welding burrs 2 formed on the welded part are removed by the deburring machine 30. Then, thus formed endless billet 1 is continuously rolled by the rolling mill 60. In FIG. 12, the "H" position is the home position of the traveling flash welding machine 20. The welding by the traveling flash welding machine 20 begins from the home position, and the welding terminates at the "A" position in the figure. After that, deburring by the deburring machine 30 begins from the "A" position, and the deburring terminates at the "B" position. FIG. 14 illustrates the conditions of deburring by the deburring machine 30. As illustrated in FIG. 14A, the vertical deburring cutter 31 descends toward the welded part, driven by the hydraulic cylinder 32, thereby removing the welding burrs on both left and right sides of the welded part. Then, as illustrated in FIG. 14B, the horizontal deburring cutter 33 travels in the horizontal direction toward the welded part, driven by the hydraulic cylinder 34, thereby removing the welding burrs from both top and bottom sides of the welded part.

According to the deburring by the deburring machine 30, there are problems of forming fins 3 at corners of the cross section of the welded part upon conducting deburring at the welded part using the vertical deburring cutter 31 or the horizontal deburring cutter 33, as shown in FIG. 14A and FIG. 14B, and giving fins 3, formed by deburring, left behind at corners of cross-section of the welded part of the billet 1, as shown in FIG. 14C. The presence of such fins, generates flaws in the succeeding rolling step, thus inducing deterioration of product quality and reducing the product yield in some cases.

There is another known deburring machine to remove welding burrs from the flash welded part, which is a rotary-blade type deburring machine, located at the downstream side of the traveling flash welding machine, to cut the welding burrs by pressing the rotating circular cutting edge against the welding burrs as disclosed in European Published Patent Application No. EP 1 057 563 A1. FIG. 15 illustrates a continuous rolling line provided with that type of deburring machine, and FIG. 16 shows a perspective view of a core part of that deburring machine.

As shown in FIG. 15, the rolling line arranges the heating furnace 10, the traveling flash welding machine 20, the deburring machine 40, and the rolling mill 60 in this sequential order. As seen in FIG. 16, the deburring machine 40 has cutting blades 41*a* and 41*b*, each having a rotating circular cutting edge. With the cutting blades 41*a* and 41*b*, the welding burr 2 formed on the top face of the welded part is removed. The cutting blades to remove the welding burrs on other faces of the welded part, (bottom face and right and left side faces) are also provided, though FIG. 16 does not show them.

According to thus structured rolling line, the leading end of the succeeding billet 1*b* delivered from the heating furnace 10 and the trailing end of the preceding billet 1*a* are welded to join together while traveling them using the traveling flash welding machine 20, and the welding burrs 2 formed on the welded part are removed by the deburring machine 40, and then thus formed endless billet 1 is continuously rolled by the rolling mill 60. In FIG. 15, the "H" position is the home position of the traveling flash welding machine 20. The welding by the traveling flash welding machine 20 begins from the home position, and the welding terminates at the "A" position in the figure. The welding burrs 2 at the welded part are removed while the billet 1 passes through the deburring machine 40. The deburring operation with that type of deburring machine 40 avoids the generation of fins 3 which raise a problem in deburring operation with the deburring machine 30, which is illustrated in FIGS. 12 to 14.

There are, however, problems in the deburring using the above deburring machine 40. That is, as illustrated in FIG. 17, when the continuously cast billet 1 is cut to a specified length in a continuous casting process using a mechanical diagonal cutter 71 equipped with a mobile cutting blade 72*a* and stationary cutting blade 72*b*, (FIG. 17A), the cut section deforms, (FIG. 17B). In this state, if the cross sections of the preceding billet 1*a* and the succeeding billet 1*b* are butted against each other, a significant misalignment 4 appears particularly at corners (edges) of the cross sections, (FIG. 17C). If flash welding is applied to these billets 1*a* and 1*b*, having that misalignment 4, (FIG. 17D), the portions near the misalignment 4 are not fully welded and result in a defect 6 caused by the misalignment 4 left behind at the welded part, (FIG. 17E). Since that type of defect 6 caused by the misalignment 4 cannot be removed by deburring (hatched part 5) by the deburring machine 40, (FIG. 17F), the defect 6 caused by the misalignment 4 is left behind at corners of the cross section of the billet 1 before rolling, (FIG. 17G). As a result, flaws appear in the succeeding rolling step, which may deteriorate the product quality and decrease the product yield.

As described above, the continuous roiling technology in the related art raises the problem that, when the welding burrs formed at the flash welded part are removed by a deburring machine, defects caused by fins or misalignment are left behind at corners of cross section at the welded part, which defects become flaws in the succeeding rolling step, thereby deteriorating the product quality and decreasing the product yield.

It would therefore be helpful to provide a continuous rolling method and a continuous rolling apparatus to attain good product quality and product yield by preventing the generation of flaws during rolling in the continuous rolling technology to manufacture steel rods, wires, and the like.

SUMMARY

A continuous rolling method is disclosed that has the steps of: flash welding a trailing end of a preceding steel piece and a leading end of a succeeding steel piece to join them together while they are traveling; deburring to remove burrs from the welded part; and rolling thus joined steel pieces; wherein the step of trimming for trimming corners of cross section of the deburred welded part is provided after the step of deburring.

A continuous rolling apparatus is also disclosed that has: a traveling flash welding machine which joins a trailing end of a preceding steel piece and a leading end of a succeeding steel piece together by flash welding while they are traveling; and a deburring machine which removes burrs from the welded part, and a rolling mill which rolls thus joined steel pieces; wherein a trimming machine to trim corners of cross section of the deburred welded part is located in the apparatus.

DETAILED DESCRIPTION

Figure 1:
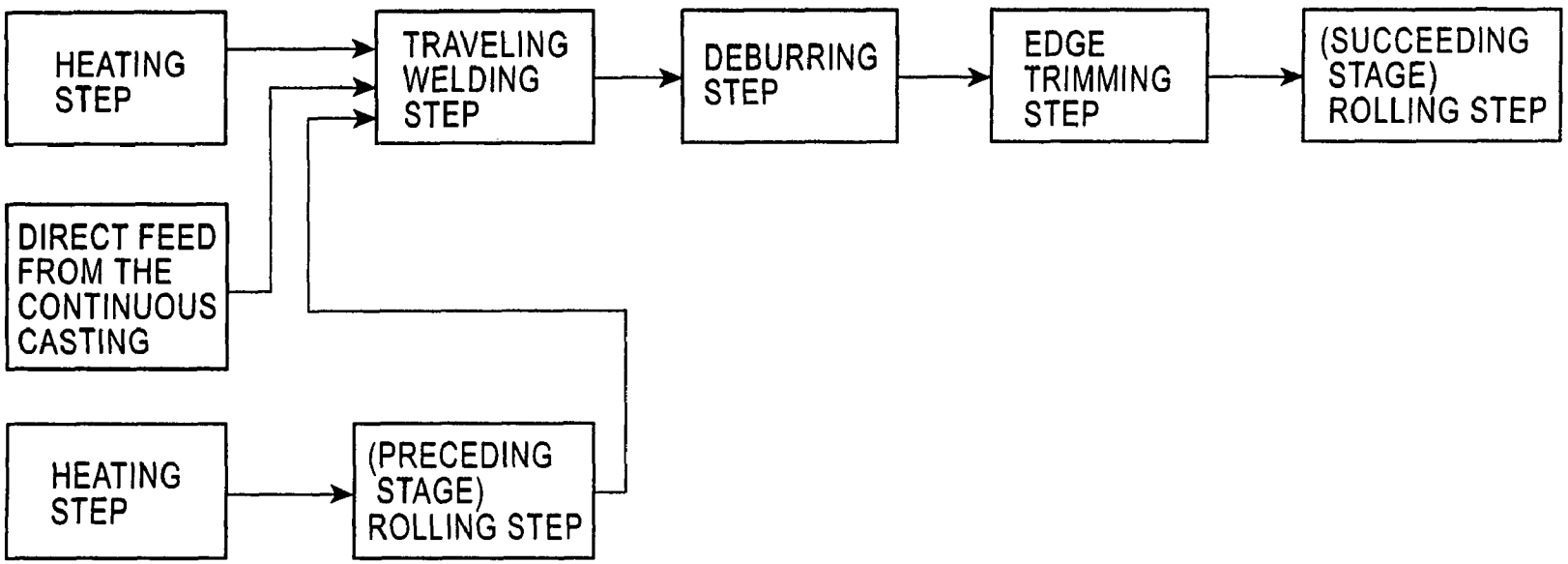
FIG. 1 shows a block flow diagram of selected aspects of the method.

It will be appreciated that the following description is intended to refer to specific aspects of this disclosure selected for illustration in the drawings and is not intended to define or limit the scope of the subject matter herein, other than in the appended claims.

FIG. 1 shows a block flow diagram of a heating step for heating steel pieces, (hereinafter represented by billets), to a specified temperature; a flash welding step for joining the trailing end of a preceding billet with the leading end of a succeeding billet while they are traveling using flash welding; a deburring step for removing burrs from the welded part; an edge trimming step for trimming corners (edges) of cross section of the deburred welded part; and a rolling step for rolling the joined billets. As illustrated in FIG. 1, the heating step may be replaced by a direct-feeding step for continuously and directly feeding the continuously cast billet. Furthermore, a preliminary rolling step for rolling the billet, which was heated in the heating step, to a specified cross section may be inserted between the heating step and the flash welding step.

Figure 2:
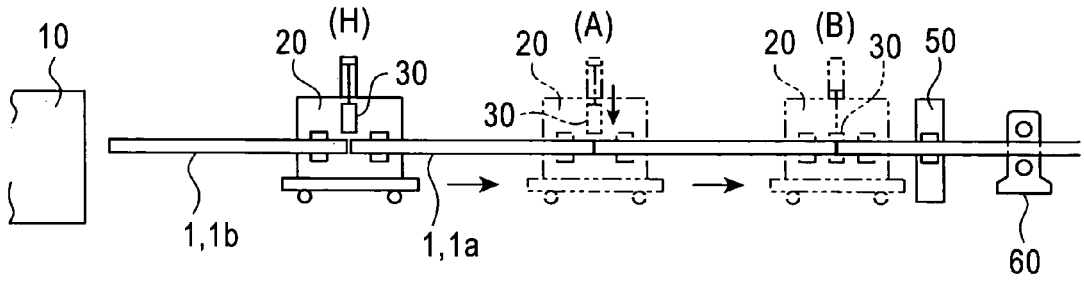
FIG. 2 illustrates the structure of selected aspects of the apparatus.

FIG. 2 illustrates the structure of apparatus that has a rolling line with a heating furnace 10, the traveling flash welding machine 20, the trimming machine 50, and the rolling mill 60, in this sequential order. The traveling flash welding machine 20 is equipped with the deburring machine 30.

Figure 13:
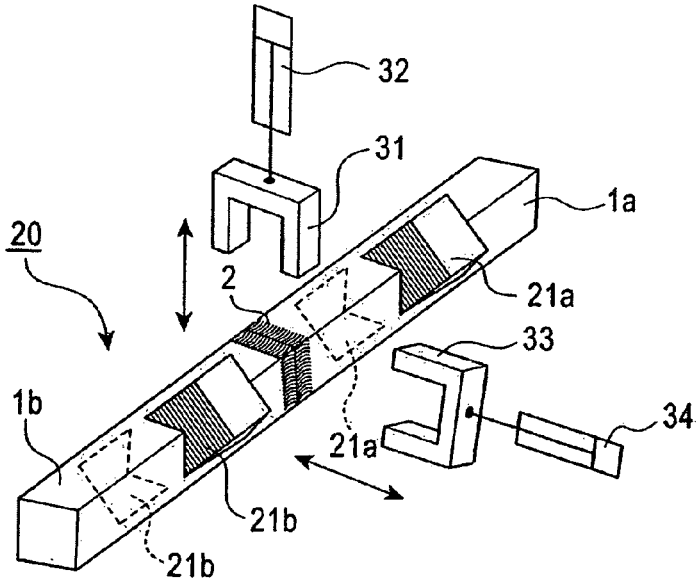
PRIOR ART FIG. 13
FIG. 13 illustrates the related art.
Figure 14A:
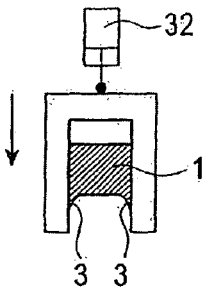
FIG. 14A, FIG. 14B, and FIG. 14C illustrate the related art.
Figure 14B:
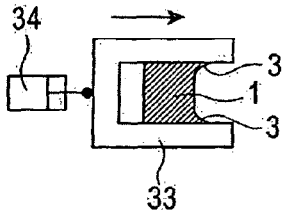
Figure 14C:
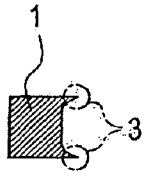
Figure 15:
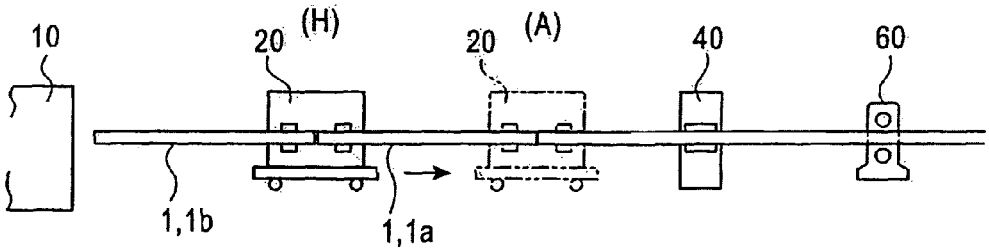
PRIOR ART FIG. 15
FIG. 15 illustrates the related art.

As shown in FIG. 13, the deburring machine 30 is equipped with the vertical deburring cutter 31 in a downward-opening angular U-shape, the hydraulic cylinder 32 to drive the vertical deburring cutter 31 in the vertical directions, the horizontal deburring cutter 33 in a side-opening angular U-shape, and the hydraulic cylinder 34 to drive the horizontal deburring cutter 33 in the horizontal directions.

Figure 3A:
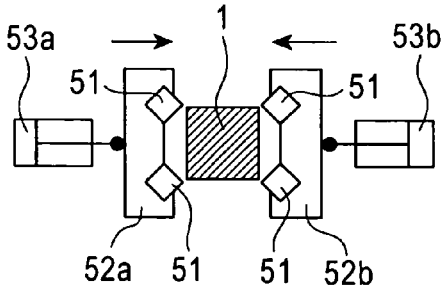
FIG. 3A and FIG. 3B illustrate a trimming machine.
Figure 3B:
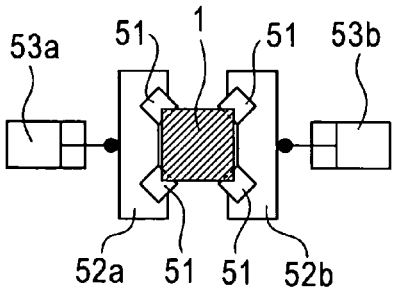

As illustrated in FIG. 3A and FIG. 3B, the trimming machine 50 has trimming cutters (cutting bite) 51, each of which is located at a position facing each of the four corners of cross section of the billet 1, has left and right frames 52*a* and 52*b*, each of which is provided with two trimming cutters, as of total four trimming cutters, in vertical row, and has hydraulic cylinders 53*a* and 53*b*, each of which drives the left frame 52*a* and the right frame 52*b*, respectively, forward and rearward in relation to the billet 1.

The position of the welded part of the billet 1 is tracked by a measuring roll (not shown) positioned in the rolling line. As shown in FIG. 3A, the left and the right frames 52*a* and 52*b* wait at a retracted position until the welded part of the billet 1 comes close to the trimming machine 50. As shown in FIG. 3B, once the welded part of the billet 1 comes close to the trimming machine 50, the left and the right frames 52*a* and 52*b* move forward to let the trimming cutters 51 trim (chamfer) the corners of cross section of the welded part to a specified degree. After completing the trimming to the specified degree, the left and the right frames 52*a* and 52*b* retract to the original waiting position.

The rolling line structured as described above conducts: welding a leading end of succeeding billet 1*b* delivered from the heating furnace 10 and a trailing end of preceding billet 1*a* to join them together while they are traveling using the traveling flash welding machine 20, thus forming an endless billet; deburring the welding burrs 2 formed on the welded part using the deburring machine 30; trimming the corners of cross section of the deburred welded part using the trimming machine 50; and rolling thus formed endless billet using the rolling mill 60.

In FIG. 2, the "H" position is the home position of the traveling flash welding machine 20. The welding by the traveling flash welding machine 20 begins from the home position, and the welding terminates at the "A" position in the figure. After that, deburring by the deburring machine 30 begins from the "A" position, and the deburring terminates at the "B" position. The corners of cross section of the welded part are trimmed while the billet 1 passes through the trimming machine 50.

FIG. 4 shows the state of deburring and trimming using the deburring machine 30 and the trimming machine 50, respectively. As illustrated in FIG. 4A, the vertical deburring cutter 31 descends toward the welded part, driven by the hydraulic cylinder 32, thus removing the welding burrs on left and right sides of the welded part. Then, as illustrated in FIG. 4B, the horizontal deburring cutter 33 moves horizontally toward the welded part, driven by the hydraulic cylinder 34, thus removing the welding burrs top and bottom sides of the welded part. After that, as illustrated in FIG. 4C, the hydraulic cylinders 53*a* and 53*b* drive the trimming cutters 51 forward to the corners of cross section of the welded part, thereby trimming the corners of cross section of the welded part to remove the fins 3.

Figure 4A:
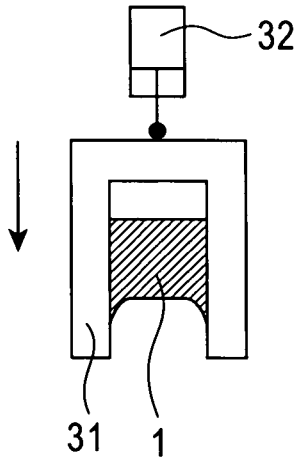
FIG. 4A, FIG. 4B, FIG. 4C, and FIG. 4D illustrate the state of deburring and trimming.
Figure 4B:
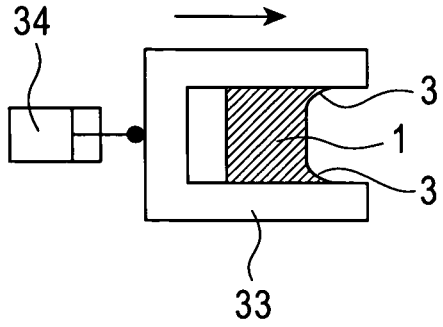
Figure 4C:
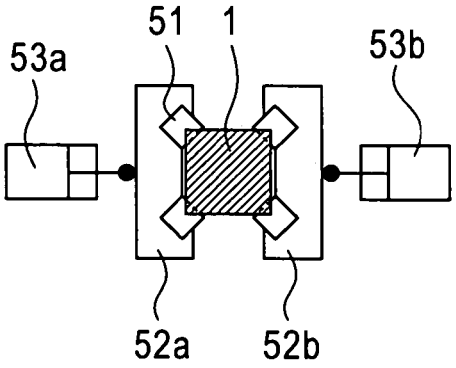
Figure 4D:
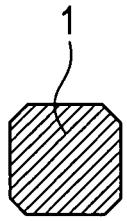

The amount of trimming may be adequately determined based on the magnitude of the existing fins 3. For example, the trimming is conducted in a range of longitudinal direction of the billet from about 100 to about 200 mm including the welded part, to depths from about 5 to about 10 mm at the corners of cross section of the welded part. By the trimming, the welded part before rolling shows a good cross sectional shape free of welding burrs and fins, as shown in FIG. 4D.

Accordingly, the above apparatus accurately removes the fins 3 existing at the corners of the cross section of the welded part after deburring, and prevents the generation of rolling flaws caused by the fins, thereby assuring good product quality and product yield.

Figure 5A:
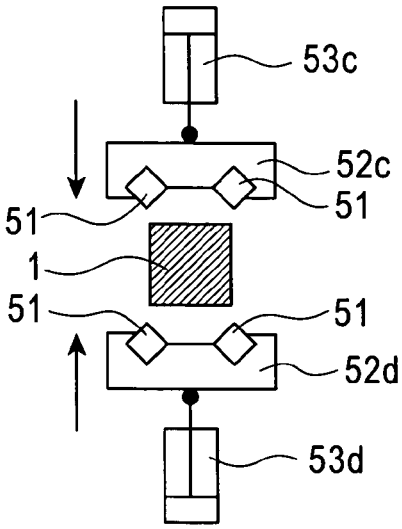
FIG. 5A and FIG. 5B illustrate another trimming machine.
Figure 5B:
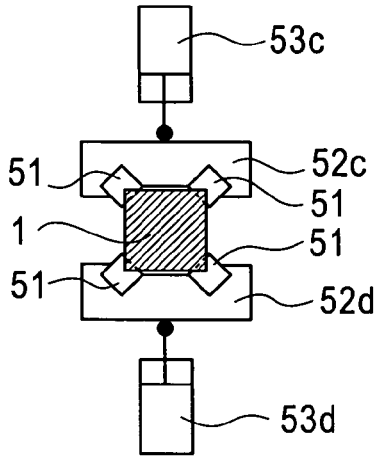

As illustrated in FIG. 5A and FIG. 5B, the trimming machine 50 may, alternatively, have each two trimming cutters 51 to each of the top and the bottom frames 52*c* and 52*d*, thereby letting each of the top frame 52*c* and the bottom frame 52*d* move forward and rearward in relation to the billet 1 using hydraulic cylinders 53*c* and 53*d*, respectively.

Figure 6A:
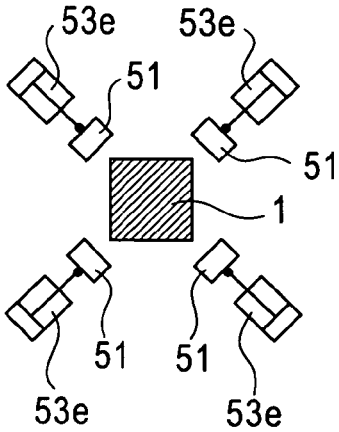
FIG. 6A and FIG. 6B illustrate a further trimming machine.
Figure 6B:
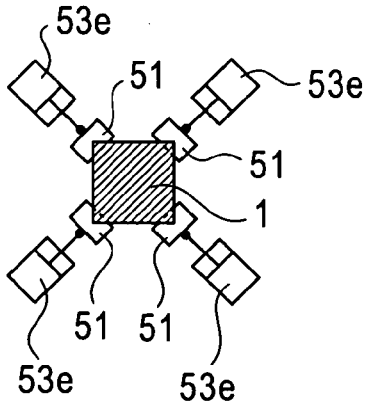

Furthermore, as illustrated in FIG. 6A and FIG. 6B, the trimming machine 50 may have each four trimming cutters 51, thereby letting each four set thereof move forward and rearward in relation to the billet 1 using a hydraulic cylinder 53*e*.

Figure 7:
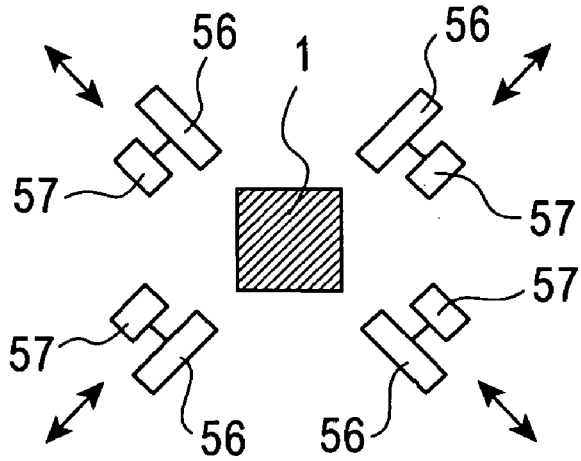
FIG. 7 illustrates still another trimming machine.
Figure 8:
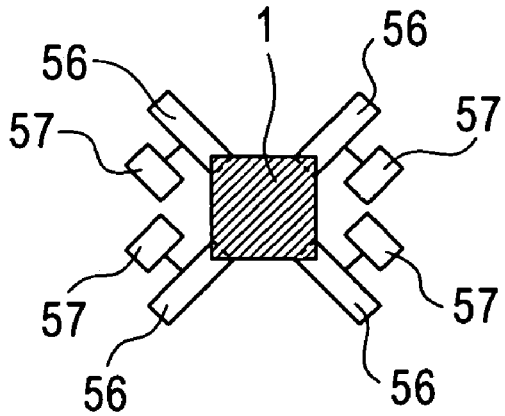
FIG. 8 illustrates yet another trimming machine.

Although the above description conducts trimming by cutting using a trimming cutter, the trimming cutter may be substituted by a grinder to conduct trimming by grinding. In this case, as illustrated in FIG. 7, four grinders 56 are located allotting each one thereof to each corner of the cross section of the billet 1, each of which grinders 56 can move forward and rearward in relation to the billet 1 using the respective hydraulic cylinders (not shown). Then, as illustrated in FIG. 8, when the welded part comes, each grinder 56 is made to move forward to the billet 1 using the relating hydraulic cylinder, and the grinders 56 are driven by respective motors 57, thus conducting trimming at the corners of cross section of the welded part.

Figure 9A:
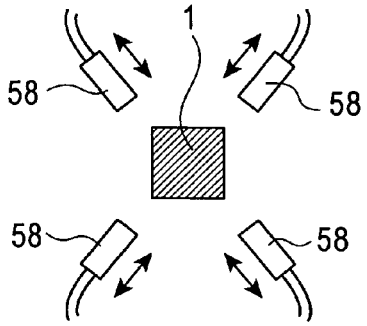
FIG. 9A and FIG. 9B illustrate yet still another trimming machine.
Figure 9B:
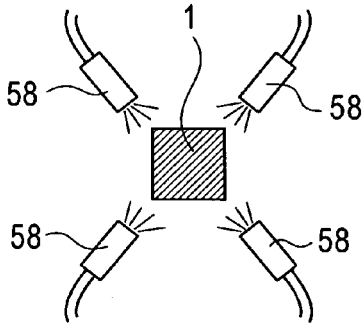

Alternatively, the trimming cutter may be replaced by a gas scarfing nozzle to conduct trimming by scarfing. In this case, as illustrated in FIG. 9A, four gas scarfing nozzles are located allotting each one thereof to each corner of the cross section of the billet 1, each of which gas scarfing nozzles 58 can move forward and rearward in relation to the billet 1 using the respective hydraulic cylinders (not shown). Then, as illustrated in FIG. 9B, when the welded part comes, each gas scarfing nozzle 58 is made to move forward to the billet 1 using the relating hydraulic cylinder, thus conducting trimming at the corners of cross section of the welded part by gas scarfing.

In the above description, if the use of billets heated in the heating furnace is changed to the direct feed of billets after the continuous casting, it is preferable that an induction heating unit is located at upstream side of the flash welding machine or between the flash welding machine and the rolling mill to heat the billets to ensure the rolling temperature.

Figure 10:
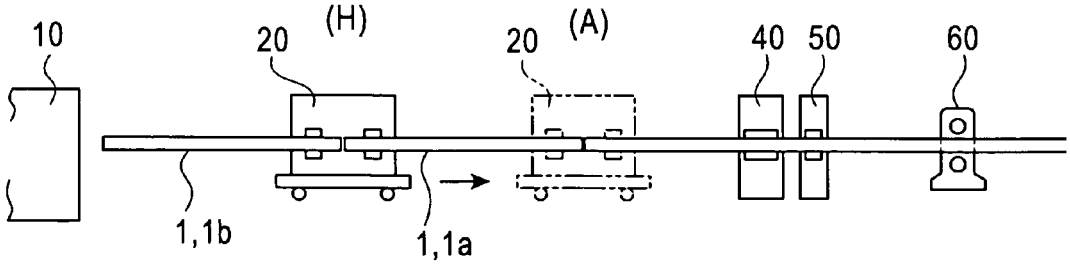
FIG. 10 illustrates the structure of another apparatus.

FIG. 10 illustrates the structure of another selected apparatus. As illustrated in the figure, the rolling line of the second embodiment has: the heating furnace 10, the traveling flash welding machine 20, the deburring machine 40, the trimming machine 50, and the rolling mill 60, in this sequential order.

Although the first described apparatus has the deburring machine built in the traveling flash welding machine, the second described apparatus locates the deburring machine at downstream side of the traveling flash welding machine. Other configurations are, of course, possible.

Figure 16:
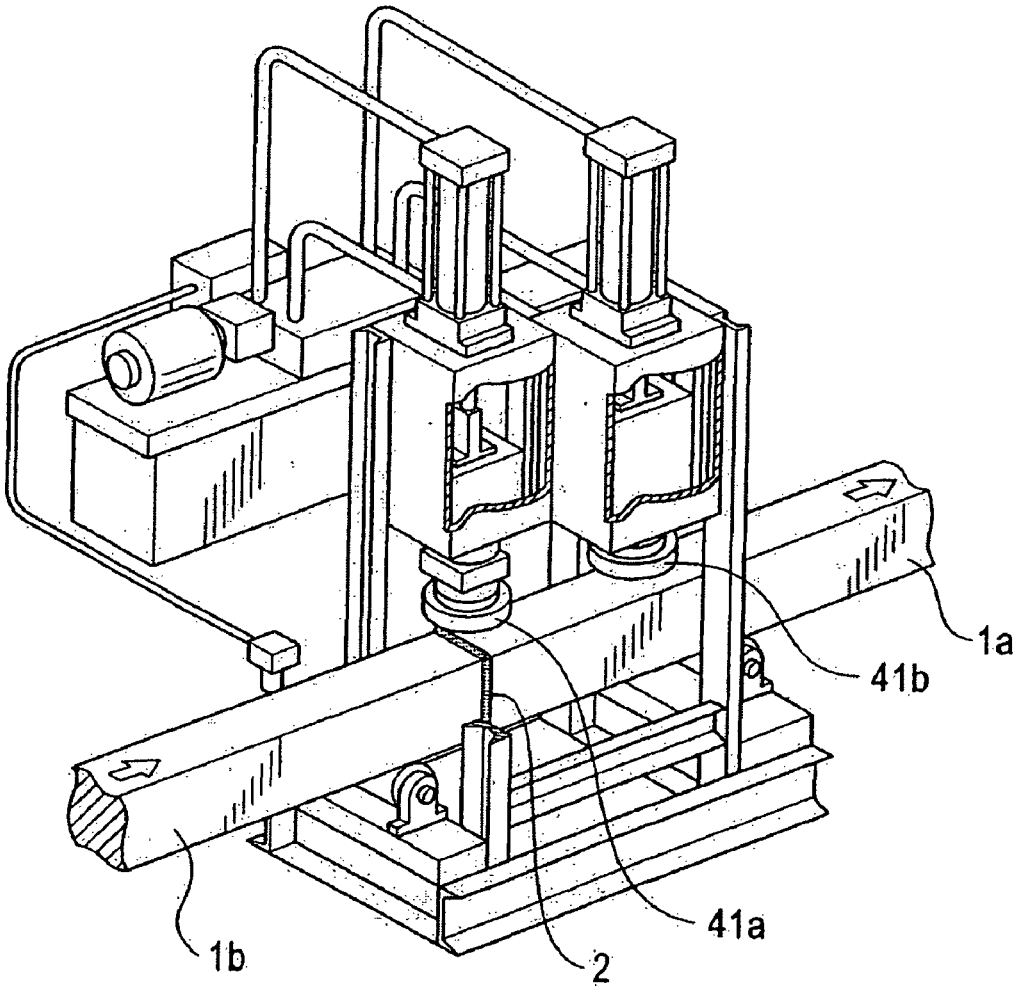
FIG. 16 illustrates the related art.
Figure 17A:
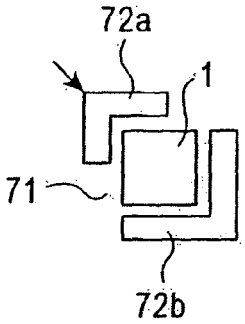
FIG. 17A, FIG. 17B, FIG. 17C, FIG. 17D, FIG. 17E, and FIG. 17F illustrate the related art.
Figure 17B:
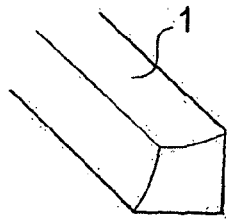
Figure 17C:
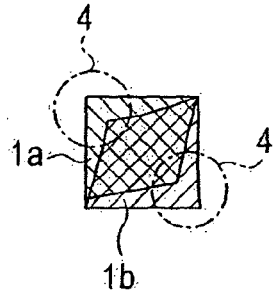
Figure 17D:
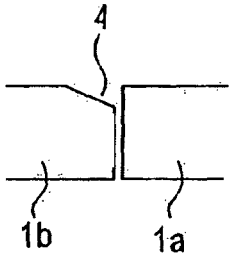
Figure 17E:
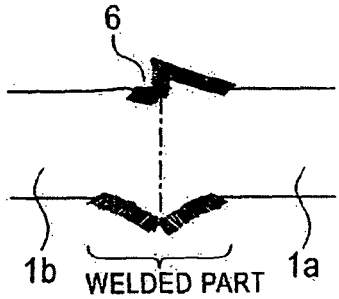
Figure 17F:
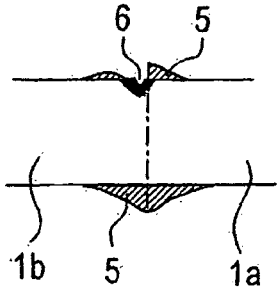
Figure 17G:
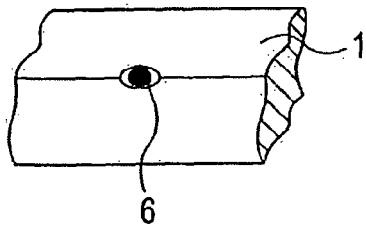
FIG. 17G illustrates the related art.

As illustrated in FIG. 16, the deburring machine 40 has cutting blades 41*a* and 41*b*, each having a rotating circular cutting edge. With the cutting blades 41*a* and 41*b*, the welding burrs 2 formed on the welded part are removed.

The rolling line structured as described above conducts: welding a leading end of a succeeding billet 1*b* delivered from the heating furnace 10 and a trailing end of a preceding billet 1*a* to join them together while they are traveling using the traveling flash welding machine 20; deburring the welding burrs 2 formed on the welded part using the deburring machine 40; trimming the corners of the cross section of the deburred welded part using the trimming machine 50; and continuously rolling thus prepared endless billet using the rolling mill 60.

In FIG. 10, the "H" position is the home position of the traveling flash welding machine 20. The welding by the traveling flash welding machine 20 begins from the home position, and the welding completes at the "A" position in the figure. Then, the welding burrs 2 at the welded part are removed while the billet 1 passes through the deburring machine 40. The corners of the cross section of welded part are trimmed while the billet 1 passes through the trimming machine 50.

With the use of the deburring machine 40, the generation of fins can be avoided. In addition, use of the trimming machine 50 removes the defect caused by misalignment.

Figure 11A:
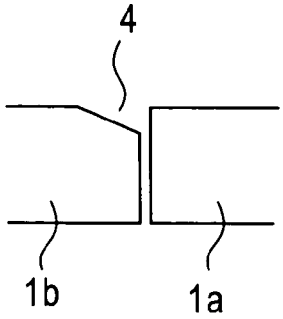
FIG. 11A, FIG. 11B, FIG. 11C, FIG. 11D, and FIG. 11E illustrate the state of trimming of another selected aspect.
Figure 11B:
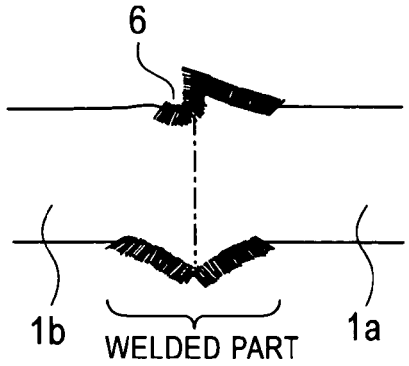
Figure 11C:
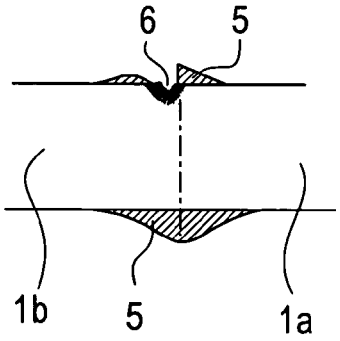
Figure 11D:
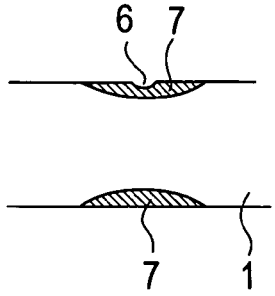
Figure 11E:
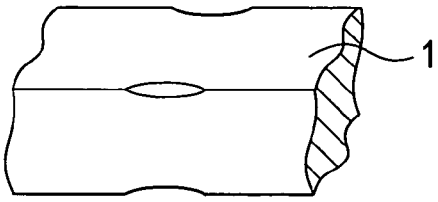
Figure 12:
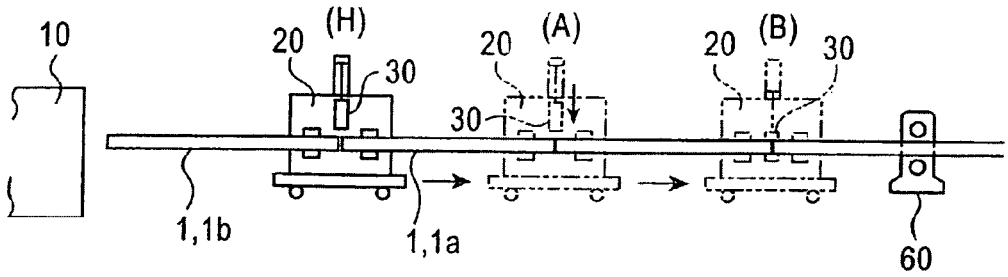
FIG. 12 illustrates the related art.

As described before, if the cross sections of the billets 1*a* and 1*b*, deformed in their cross sectional shape by cutting after continuous casting, are butted against each other, a significant misalignment 4 appears particularly at corners (edges) of the cross sections. As illustrated in FIG. 11, if flash welding is applied to these billets 1*a* and 1*b*, having that misalignment 4, (FIG. 11A), the portions near the misalignment 4 are not fully welded to give a defect 6 caused by the misalignment 4 left behind at the welded part, (FIG. 11B). Although that type of defect 6 caused by the misalignment 4 cannot be removed by deburring (hatched part 5) by the deburring machine 40, (FIG. 11C), the defect 6 can be removed by the trimming of corners of the cross section of the welded part, (hatched part 7) using the succeeding trimming machine 50, (FIG. 11D), thereby providing the billet 1 free from the defect 6 caused by the misalignment 4, (FIG. 11E).

The amount of trimming may be adequately determined based on the magnitude of the existing misalignment 4. For example, the trimming is conducted in a range of longitudinal direction of the billet from about 100 to about 200 mm including the welded part, to depths from about 5 to about 10 mm at the corners of cross section of the welded part. By the trimming, the welded part of the billet before rolling shows a good cross sectional shape free of welding burrs and of defect caused by misalignment.

Accordingly, the apparatus removes accurately the defect, caused by misalignment, left behind at the corners of the cross section of the welded part after deburring, and prevents the generation of rolling flaws caused by misalignment, thereby assuring good product quality and product yield.

The invention claimed is:

1. A continuous rolling method for steel billets comprising:

a) flash welding a trailing end of a preceding steel billet and a leading end of a succeeding steel billet to join the preceding steel billet and the succeeding steel billet together while the preceding steel billet and succeeding steel billet are traveling;

b) forming a burr at a resulting welded portion during flash welding and forming a defect when the preceding steel billet and the succeeding steel billet are misaligned during flash welding;

c) deburring to remove the burrs from the resulting welded portion, wherein the deburring forms a fin at a corner of the cross section of the resulting welded portion;

d) trimming 1) the fin from the corner of a cross section of the resulting welded portion deburred in step b) and 2) any defects caused by misalignment of the preceding steel billet and the succeeding steel billet, wherein the trimming is to a depth of 5 to 10 mm and a length of between 100 and 200 mm along a longitudinal direction of the preceding steel billet and the succeeding steel billet; and e) rolling the preceding steel billet and the succeeding steel billet joined in step a).

2. The continuous rolling method according to claim 1, wherein trimming the fins comprises trimming with a trimming cutter.

3. The continuous rolling method according to claim 1, wherein trimming the fins comprises trimming with a grinder.

4. The continuous rolling method according to claim 1, wherein trimming the fins comprises trimming by gas scarfing.

5. The continuous rolling method according to claim 1, wherein the deburring comprises deburring burrs from a resulting welded portion with a deburring cutter.

6. The continuous rolling method according to claim 1, wherein the deburring comprises deburring burrs from a resulting welded portion with rotating cutting blades.

* * * * *